United States Patent [19]

Woytiuk et al.

[11] 4,100,002

[45] Jul. 11, 1978

[54] METHOD FOR PRODUCING POWDER FILLED CABLE

[75] Inventors: Leo Victor Woytiuk, Pointe Clair; Ronald Yves Mayer, LaSalle; George B. Kepes, Montreal, all of Canada

[73] Assignee: Northern Telecom Limited, Montreal, Canada

[21] Appl. No.: 564,070

[22] Filed: Apr. 1, 1975

[51] Int. Cl.[2] ..... H01B 13/06

[52] U.S. Cl. ..... 156/48; 156/56

[58] Field of Search ..... 156/47, 48, 51, 56; 174/23 R, 23 C, 102 P, 118; 427/32, 117, 202, 216; 57/162, 164

[56] References Cited

U.S. PATENT DOCUMENTS

| | | | |
|---|---|---|---|
| 1,892,663 | 1/1933 | Delmar | 156/48 |
| 2,507,508 | 5/1950 | Elliott et al. | 174/23 C |
| 2,722,963 | 11/1955 | McCleery | 156/48 |
| 2,789,926 | 4/1957 | Finholt et al. | 427/120 |
| 3,019,126 | 1/1962 | Bartholomew | 427/29 |
| 3,546,017 | 12/1970 | Pendelton et al. | 427/32 |
| 3,677,809 | 7/1972 | Klement | 427/32 |
| 3,717,716 | 2/1973 | Biskeborn et al. | 174/23 C |
| 3,745,231 | 7/1973 | Eager, Jr. et al. | 156/48 |
| 3,803,339 | 4/1974 | Speekman | 174/23 C |

FOREIGN PATENT DOCUMENTS

| | | | |
|---|---|---|---|
| 1,936,872 | 3/1971 | Fed. Rep. of Germany | 174/23 C |
| 2,006,359 | 8/1971 | Fed. Rep. of Germany | 174/23 C |

*Primary Examiner*—William A. Powell
*Assistant Examiner*—William H. Thrower

[57] ABSTRACT

In a method of continuously producing a multi-stranded powder filled core for an electric cable, the conductors forming the core are kept apart over a length of their travel while powder is applied to them electrostatically, after which the conductors are brought together to form the core. Preferably the conductors are oil coated prior to the application of the powder, the formed core is passed through a powder bath, and a core wrap tape is oiled and applied to the core, the tape being also powder coated on its contacting surface if applied longitudinally to the core rather than helically. For a metal sheathed cable the metal tape forming the sheath may be oiled and powder coated on the surface contacting the core wrap prior to the application of the metal tape to the core unit, to form an intervening layer of powder between the core wrap and the sheath.

8 Claims, 3 Drawing Figures

METHOD FOR PRODUCING POWDER FILLED CABLE

This invention relates to the production of a multi-stranded sheathed or jacketed electric cable having the voids within the sheath or jacket filled with powder.

Electric cables having stranded conductors enclosed in a sheath or jacket usually have the voids within the sheath or jacket filled with material to block water penetration and migration. Jellies and greaselike materials have conventionally been used for this purpose but because of their disadvantages it has recently been proposed to use powdered material comprising a mixture of hydrophobic and hydrophilic compounds.

It is an object of the present invention to provide a method of, and an apparatus for, producing a powder filled, multi-stranded electric cable.

In its broadest aspect the invention relates to the continuous production of an electric cable having a plurality of conductors forming a stranded core enclosed in a sheath or jacket with the voids inside the sheath or jacket being at least partially filled with a powder. During the production of this cable the powder is introduced by maintaining the conductors in spaced lateral relationship over a predetermined length of travel, applying powder electrostatically to the separated conductors, and bringing the conductors together to form the core. The laterally spaced conductors are coated with oil prior to the electrostatic application of the powder.

An example embodiment of the invention is shown in the accompanying drawings in which.

Figure 1:
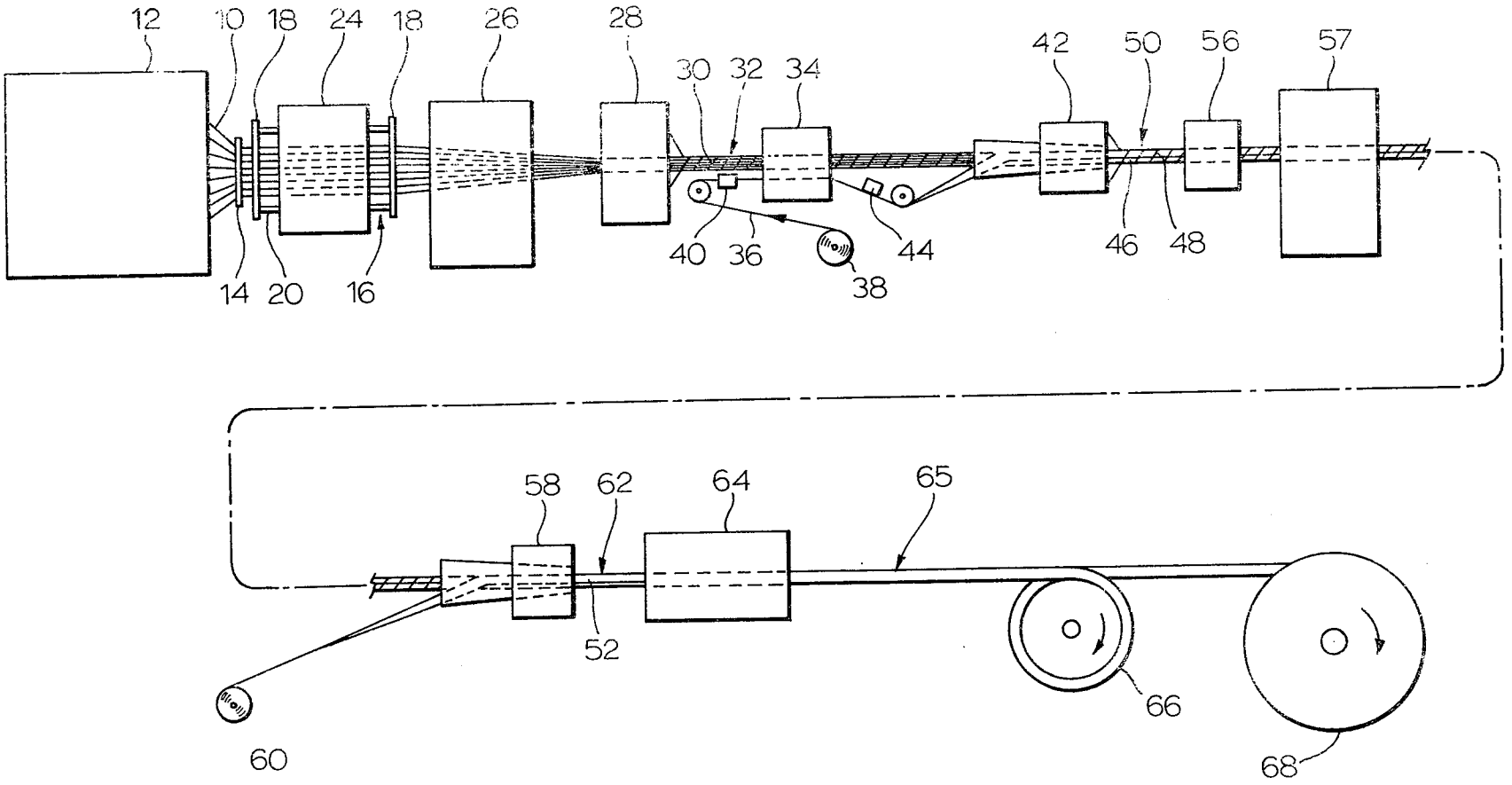
FIG. 1 is a schematic flow diagram of apparatus according to the invention for the production of an electric cable.
Figure 2:
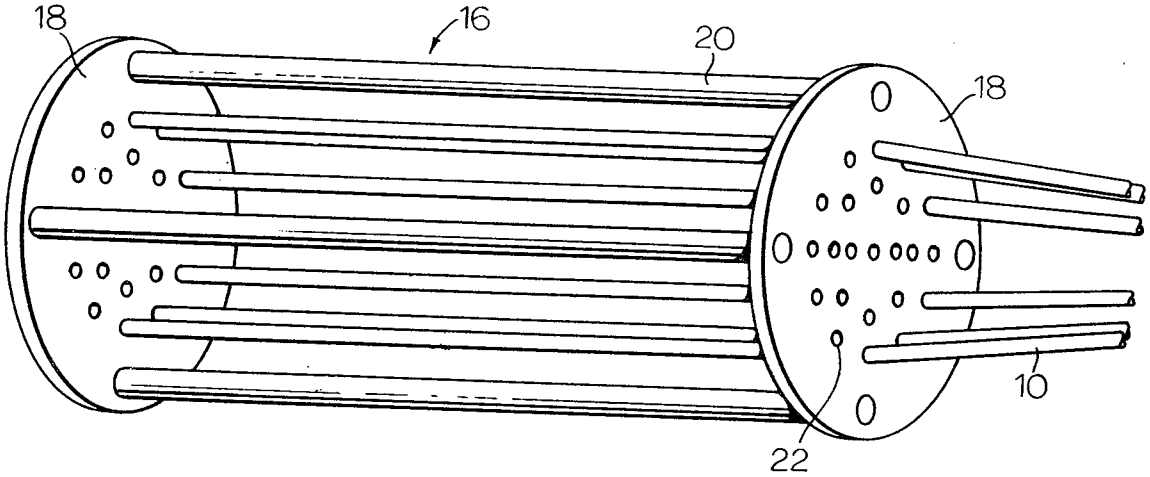
FIG. 2 is a perspective view of the guide frame of FIG. 1.

In the example embodiment shown in the schematic diagram of FIG. 1 of the drawings a plurality of insulated wire conductors 10 are drawn from a strander or oscillator 12 through a perforated face plate 14 where they emerge in parallel, spaced relationship. To maintain this spaced relationship over a predetermined length of travel, conductors 10 emerging from face plate 14 pass through a guide frame 16. As seen in FIG. 2, guide frame 16 consists of a pair of perforated templates 18 spaced apart by a plurality of parallel rods 20 and having aligned apertures 22. Guide member 16 traverses an oil applicator or atomizer 24 which coats conductors 10 with a thin film of oil. Emerging from guide frame 16, laterally spaced conductors 10 pass through an electrostatic powder applicator 26 which deposits a layer of powder on each conductor over the film of oil already covering the conductor. From guide frame 16 conductors 10 converge into a binder unit 28 where a ribbon 30 is wound helically around the conductors to form a unitary core 32.

Figure 3:
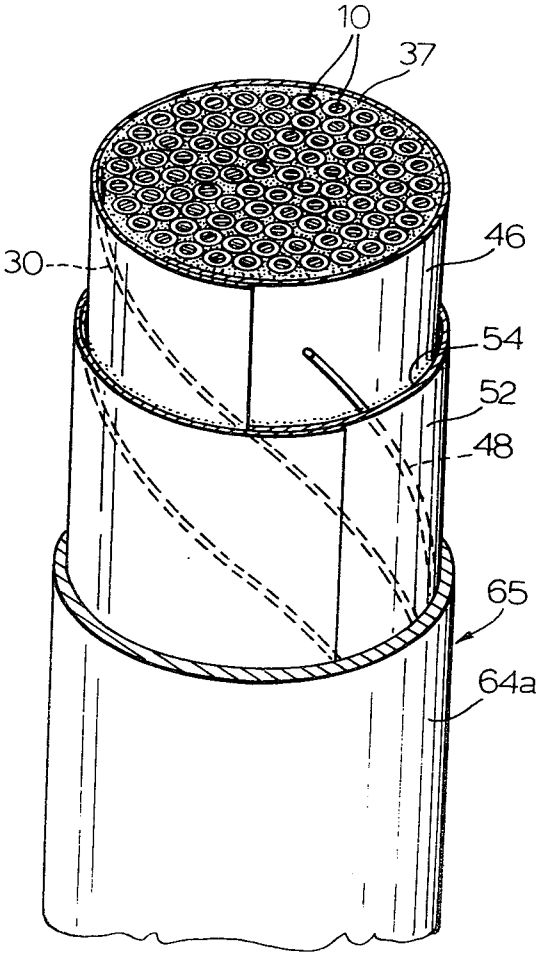
FIG. 3 shows an electric cable produced according to the invention.

From binder unit 28 core 32 passes into a powder bath unit 34 above a tape 36 of plastic material such as polyester. Tape 36 is drawn continuously from a roll 38 and passes beneath an applicator 40 which applies oil to the upper surface of the tape. Core 32 passes through the powder bath to saturate the core with the powder and to drop excess powder onto the oiled upper surface of tape 36. After emerging from powder bath 34 both core 32 and tape 36 enter a core wrap forming unit 42 but before entering unit 42 the tape passes beneath a wiper 44 which removes excess powder from the tape. Core wrap unit 42 applies tape 36 longitudinally about core 32 to form a core wrap 46, thus retaining powder 37 between and about conductors 10 as seen in FIG. 3 of the drawings. A binder ribbon 48 is wound on core wrap 46 to form a completed cable core structure 50. Tape 36 may alternately be wrapped helically about core 32 to form core wrap 46, in which case the tape is oiled but preferably not powdered and no binder ribbon 48 is required.

Cable core 50 may be covered further by a metal sheath 52 with an intervening layer 54 of powder between the metal sheath and underlying core wrap 46, as seen in FIG. 3. To achieve this, cable core 50 is passed through an oil applicator 56 similar to applicator 24 and then through a powder bath 57 similar to bath 34 enabling the powder to adhere to the outer surface of the cable core which then enters a tape forming unit 58. A roll 60 of metal tape is fed directly into tape forming unit 58 where it is oriented longitudinally with cable core 50 and wrapped laterally about the core to form sheath 52, thus enclosing the powder on the outer surface of the cable core to form powder layer 54 and emerging as sheathed cable 62.

Sheathed cable 62 may be jacketed by passing it through an extruder 64 which covers sheath 52 with an outer layer of thermoplastic material such as polyethylene 64a. The jacketed cable 65 is then passed over a capstan 66 onto a take-up reel 68 for storage or shipment.

It will be appreciated that strander or oscillator 12, oil applicators 24 and 56, binder 28, core wrap forming unit 42, metal tape forming unit 58, and extruder 64 are all of conventional design and well known in the electric cable making art. An electrostatic powder applicator 26 suitable for the purpose of the present invention is supplied by Electrostatic Equipment Corporation of New Haven, Connecticut, U.S.A., Model 400B. Electrostatic powder spray gun systems are also suitable.

In one example application of the inventive process, oil applicators 24 and 56 coated a hydrophobic oil onto conductors 10 and onto wrapped core 50 respectively while electrostatic applicator 26 covered the oiled conductors with a mixture of hydrophilic and hydrophobic powder, the same powder mixture being used in baths 34 and 57. More specifically the oil was a low viscosity parafinic oil while the powder was a mixture of coated calcium carbonate and polyacrylamide, the polyacrylamide being between 8% and 30% of the mixture. The voids within the core were at least 30% filled with the powder mixture.

While a sheathed and jacketed cable has been described in the example embodiment it will be appreciated that core 32 could be passed directly into extruder 64 to form a jacketed core having no intermediate metal sheath.

I claim:

1. In a method of continuously producing an electric cable having a plurality of conductors forming a stranded core enclosed in a sheath or jacket, the voids within the sheath or jacket being at least partially filled with powder, the sequential steps of:

maintaining the conductors in spaced lateral relationship over a predetermined length of travel;

applying a coating of oil to the laterally spaced conductors;

applying powder electrostatically to the separated conductors; and bringing the powdered conductors together to form said core.

2. A method as claimed in claim 1 including the added step of applying a binder ribbon helically around the core to maintain the conductors in stranded relationship and the powder therebetween.

3. A method as claimed in claim 2 including the added sequential steps of:

applying a coating of oil to one side of a continuous tape;

powder coating said one side of the continuous tape;

applying the powder coated tape longitudinally over the core to form a covering layer thereon with said one side inwardly directed; and applying a further binder ribbon around the tape to maintain the covering layer on the core.

4. A method as claimed in claim 3 including the added steps of:

oil coating and powder coating a further continuous tape; and applying the further coated tape over the covering layer on the stranded core to form a sheath or jacket thereon.

5. A method as claimed in claim 1 including the added step of applying a continuous tape helically over thd core to form a covering layer thereon, one side of said continuous tape being oil coated prior to the application of the tape over the core, said one side being inwardly directed with respect to the core.

6. A method as claimed in claim 1 including the added steps of:

oil coating a continuous tape;

passing the bound core through a bed of said powder and allowing excess powder falling from said core to fall on the oiled tape;

applying the coated tape over the binder ribbon to form a covering layer on the stranded core; and applying a further binder ribbon to maintain the covering layer on the core.

7. A method as claimed in claim 1 in which the oil is applied in vapor form to the conductors.

8. A method as claimed in claim 1 in which the powder is a mixture of hydrophilic and hydrophobic materials.

* * * * *